US005742972A

United States Patent [19]

Bredall et al.

[11] Patent Number: 5,742,972

[45] Date of Patent: Apr. 28, 1998

[54] TOOTHBRUSH

[75] Inventors: William A. Bredall, Pacifica, Calif.; Miklos M. Breuer, Newton, Mass.; Ximena A. Gavino; Christopher Loew, both of San Francisco, Calif.; Jeffrey Scott Meessmann; Douglas J. McDowell, both of Iowa City, Iowa; Alberto B. Sabato, Atherton, Calif.; Jean L. Spencer, Boston, Mass.; James D. Vidra, Half Moon Bay, Calif.; Stanley Wreford, Boston, Mass.

[73] Assignee: Gillette Canada Inc., Kirkland, Canada

[21] Appl. No.: 803,704

[22] Filed: Feb. 21, 1997

Related U.S. Application Data

[63] Continuation of Ser. No. 573,735, Dec. 18, 1995, abandoned, which is a continuation of Ser. No. 409,616, Mar. 23, 1995, abandoned, which is a continuation of Ser. No. 970,327, Nov. 2, 1993, abandoned.

[51] Int. Cl.[6] ..... A46B 9/04

[52] U.S. Cl. ..... 15/167.1; 15/DIG. 5

[58] Field of Search ..... 15/DIG. 5, 167.1, 15/207.2

[56] References Cited

U.S. PATENT DOCUMENTS

| | | |
|---|---|---|
| D. 201,867 | 8/1965 | Newman . |
| D. 239,221 | 3/1976 | Wasserman . |
| D. 248,696 | 8/1978 | Greenberg . |
| D. 259,976 | 7/1981 | Seelig . |
| D. 272,688 | 2/1984 | Stocchi . |
| D. 272,689 | 2/1984 | Stocchi . |

(List continued on next page.)

FOREIGN PATENT DOCUMENTS

| | | | |
|---|---|---|---|
| 0360766 | 3/1990 | European Pat. Off. | 15/167.1 |
| 1100290 | 9/1955 | France | 15/167.1 |
| 0177878 | 3/1954 | Germany | 15/167.1 |
| 3433763 | 2/1986 | Germany | 15/167.1 |
| 333001 | 9/1958 | Switzerland | 15/167.1 |
| 0291657 | 6/1928 | United Kingdom | 15/167.1 |
| 288287 | 6/1928 | United Kingdom | 15/167.1 |

OTHER PUBLICATIONS

Sample of "Ortho" brush, manufactured and sold by Oral–B Laboratories, Redwood City, CA (1989).

*Primary Examiner*—Randall Chin
*Attorney, Agent, or Firm*—Chester Cekala

[57] ABSTRACT

The present invention relates to a toothbrush which exhibits superior interproximal and gingival margin cleaning. The toothbrush includes an elongated handle member connected to a toothbrush head member. The head is divided into two regions. A "toe" region is defined as the part of the head which is furthest from the handle and a "heel" region is the portion of the head which is closest to the handle. A multiplicity of bristles extend from the heel region of the head; the distal ends of these bristles form a longitudinally aligned concave shape when viewed on end. Likewise, a multiplicity of bristles extend from the toe region of the head, wherein said bristles extending from the toe portion of the head are at least as tall as the general height of said bristles extending from the heel portion when viewed from the side and wherein the side profile view of the distal ends of the bristles extending from the toe portion form a generally linear surface which forms an angle relative to the general plane of the bristles extending from the heel portion of from 0° to about 45° declining from the edge of the toe portion distal to the heel portion to the edge of the toe portion which is proximal to the heel portion.

5 Claims, 4 Drawing Sheets

U.S. PATENT DOCUMENTS

| | | | |
|---|---|---|---|
| D. 272,690 | 2/1984 | Stocchi . | |
| D. 273,635 | 5/1984 | Stocchi . | |
| D. 289,703 | 5/1987 | Yaffe . | |
| D. 292,448 | 10/1987 | Vianello . | |
| D. 319,148 | 8/1991 | Emily . | |
| 669,402 | 3/1901 | Rose . | |
| 1,018,927 | 2/1912 | Sarrazin . | |
| 1,337,173 | 4/1920 | White . | |
| 1,440,785 | 1/1923 | Levis . | |
| 1,456,535 | 5/1923 | Cartwright . | |
| 1,642,465 | 9/1927 | Sheetz . | |
| 1,927,365 | 9/1933 | Frolio . | |
| 3,188,673 | 6/1965 | Newman . | |
| 3,378,870 | 4/1968 | Matsunaga . | |
| 3,583,019 | 6/1971 | Conklin, Jr. | 15/167.1 |
| 3,678,528 | 7/1972 | Haije . | |
| 3,722,020 | 3/1973 | Hills . | |
| 3,742,549 | 7/1973 | Scopp et al. . | |
| 4,020,521 | 5/1977 | Velasquez . | |
| 4,031,587 | 6/1977 | Dietrich | 15/167.1 |
| 4,570,282 | 2/1986 | Kaufman et al. . | |
| 4,712,267 | 12/1987 | Cheng . | |
| 4,800,608 | 1/1989 | Key . | |
| 4,847,936 | 7/1989 | Moglianese et al. . | |
| 4,882,803 | 11/1989 | Rogers et al. . | |
| 4,894,880 | 1/1990 | Aznovoorian . | |
| 5,046,212 | 9/1991 | O'Conke . | |

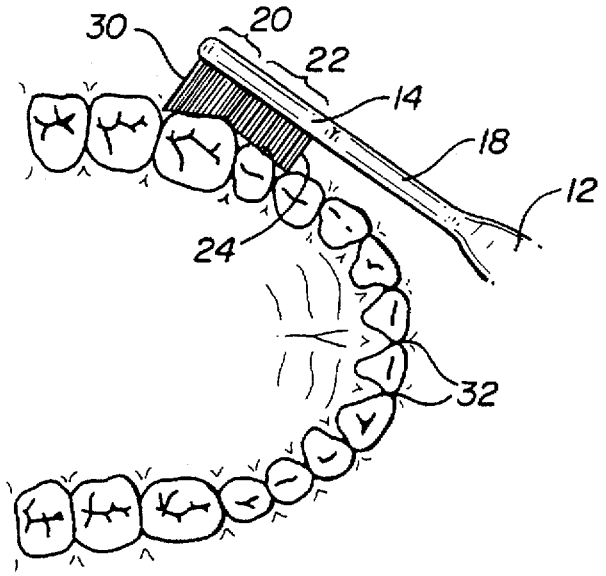
FIG-11
FIG-12
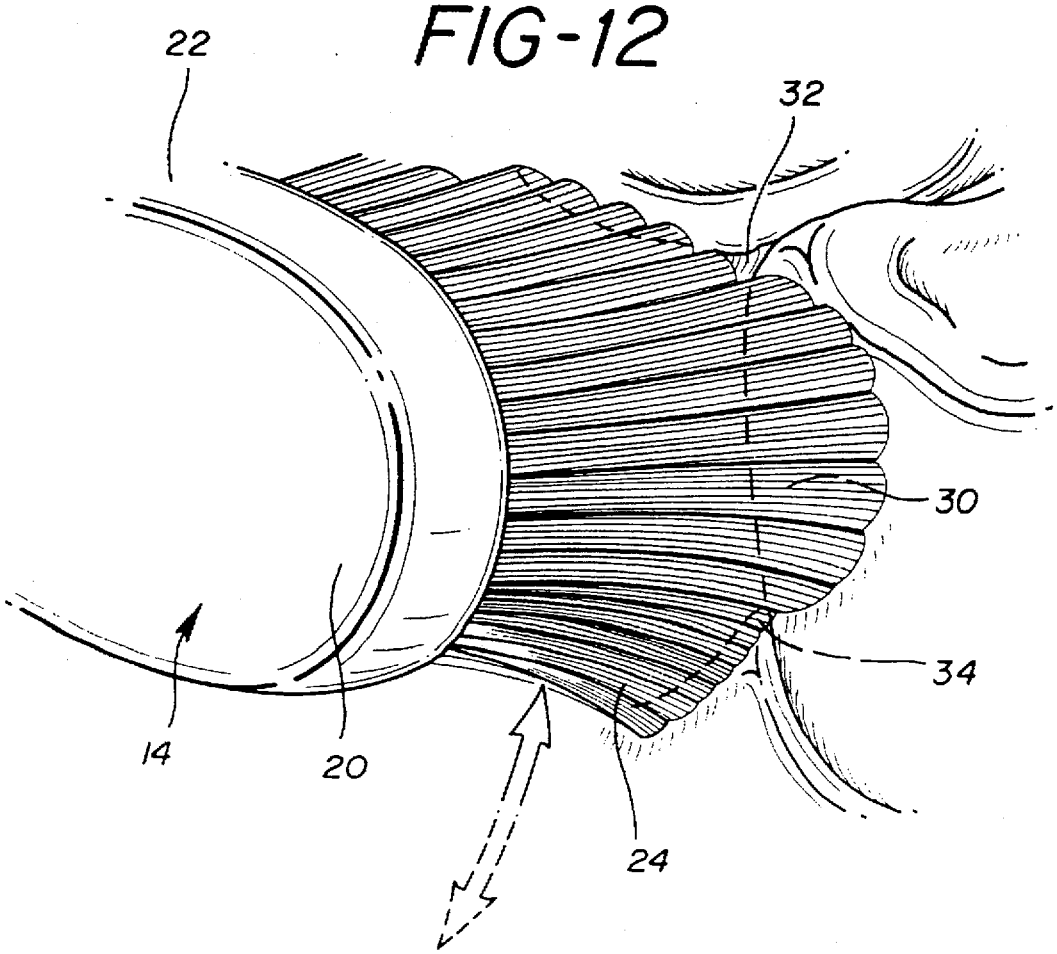

TOOTHBRUSH

This application is a continuation of Ser. No. 08/573,735 filed Dec. 18, 1995, now abandoned which is a continuation of Ser. No. 08/409,616 filed Mar. 23, 1995, now abandoned which is a continuation of Ser. No. 07/970,327 filed Nov. 2, 1993, now abandoned.

BACKGROUND OF THE INVENTION

1. Field of the Invention

The present invention relates to toothbrushes, and more particularly, to toothbrushes which exhibit a three-dimensional bristle profile to provide improved cleaning of interproximal and gingival margin regions.

2. Description of the Prior Art

Toothbrushing and flossing are fundamental steps in achieving good oral hygiene. Flossing, unfortunately, has not met with widespread acceptance amongst the general populace. Furthermore, even people who floss, oftentimes, do not perform adequate flossing in hard-to-reach areas of the mouth. Accordingly, the importance of providing a brush which achieves improved cleaning along hard-to-reach areas like the gingival margin and interproximal regions is heightened. Unfortunately, while most commercially available toothbrushes clean the outer buccal face of teeth adequately, they fail to provide improved cleaning of plaque and debris from the gingival margin, interproximal areas and other hard to reach areas of the mouth.

Applicants have discovered that a substantial improvement in toothbrush performance may be realized by optimizing toothbrush design for both interproximal and gingival margin cleaning. In particular, the present invention comprises a toothbrush having a head with a grooved "heel" portion which is particularly suited to cleaning the gingival margin and a "toe" portion which is particularly suited to interproximal cleaning. Furthermore, Applicants have observed that an angled "toe" portion exhibits improved cleaning in areas of the mouth which are difficult to reach with standard toothbrushes. These features in combination with several other important operating characteristics will render a toothbrush particularly adept at accomplishing the aforementioned objectives.

Toothbrushes having a groove centered longitudinally along the entire bristle pattern are generally known to those skilled in the art. Oral-B Laboratories, Redwood City, Calif., markets the "ORTHO" brush which is intended to more effectively clean debris from orthodontic brackets and wires. Also, U.S. Pat. No. 3,722,020 to Hills, describes a toothbrush which includes a generally planar head portion having a plurality of bristles forming a concave surface. However, Applicants believe that these prior art toothbrushes do not exhibit all of the operating characteristics identified hereinafter as important in simultaneously improved interproximal and gingival margin cleaning.

Furthermore, toothbrushes having a distinct "toe" surface along the side profile of the brush head are also generally known to those skilled in the art. U.S. Pat. No. 4,800,608 to Key describes a toothbrush wherein the head is bent at a fixed obtuse angle. The Key brush is said to provide superior cleaning of the lingual, buccal, embrasure, and distal aspects of the teeth and gums. Also U.S. Pat. No. 4,712,267 to Cheng; U.S. Pat. No. 5,046,212 to Conke; U.S. Pat. No. 1,337,173 to White; U.S. Pat. No. 1,440,785 to Levis; U.S. Pat. No. 1,927,365 to Frolio; and Des. 49,472 to Dierke relate generally to toothbrushes with concave side-view heads. However, it is believed that these known prior art toothbrushes also do not exhibit all of the operating characteristics identified hereinafter as important in simultaneously improved interproximal and gingival margin cleaning.

These and other objectives will become evident from the following.

SUMMARY OF THE INVENTION

In accordance with one aspect of the present invention, a toothbrush is provided which exhibits superior interproximal and gingival margin cleaning. The toothbrush includes an elongated handle member connected to a toothbrush head member. The head is divided into two regions. A "toe" region is defined as the part of the head which is furthest from the handle and a "heel" region is the portion of the head which is closest to the handle. A multiplicity of bristles extend from the heel region of the head; the distal ends of these bristles form a longitudinally aligned concave shape when viewed on end. Likewise, a multiplicity of bristles extend from the toe region of the head, wherein said bristles extending from the toe portion of the head are at least as tall as the general height of said bristles extending from the heel portion when viewed from the side and wherein the side profile view of the distal ends of the bristles extending from the toe portion form a generally linear surface which forms an angle relative to the general plane of the bristles extending from the heel portion of from 0° to about 45° declining from the edge of the toe portion distal to the heel portion to the edge of the toe portion which is proximal to the heel portion.

BRIEF DESCRIPTION OF THE DRAWINGS

While the specification concludes with claims which particularly point out and distinctly claim the invention, it is believed the present invention will be better understood from the following description of several particularly preferred embodiments taken in conjunction with the accompanying drawings, in which like reference numerals identify similar elements and wherein:

FIG. 11 is a plan view of one embodiment of this invention illustrating the cleansing action of the toe bristle surface in the interproximal region between the teeth.

FIG. 12 is an end view of the toe portion of according to FIG. 4 showing to posterior heel portion's position along the gingival margin and buccal surfaces during brushing.

DESCRIPTION OF PARTICULARLY PREFERRED EMBODIMENTS

Figure 1:
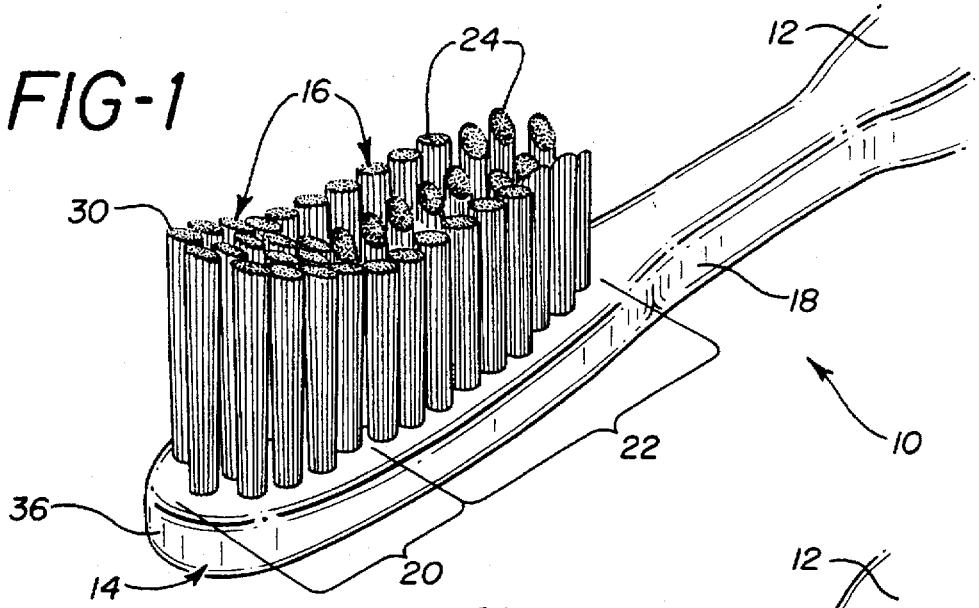
FIGS. 1, 2 and 3 are perspective views of embodiments of a toothbrush of the present invention.
Figure 2:
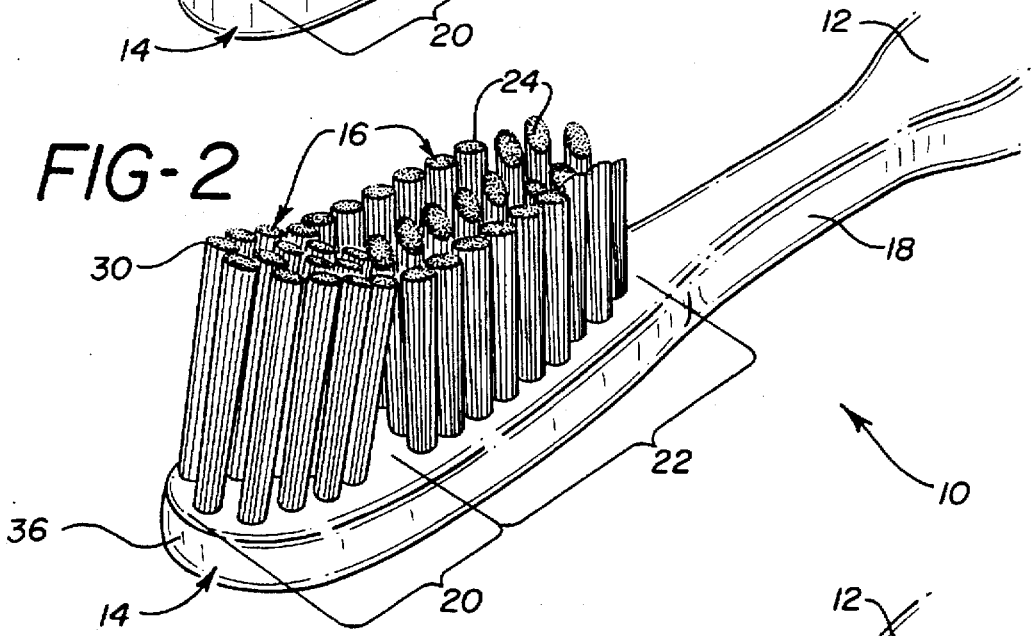
Figure 3:
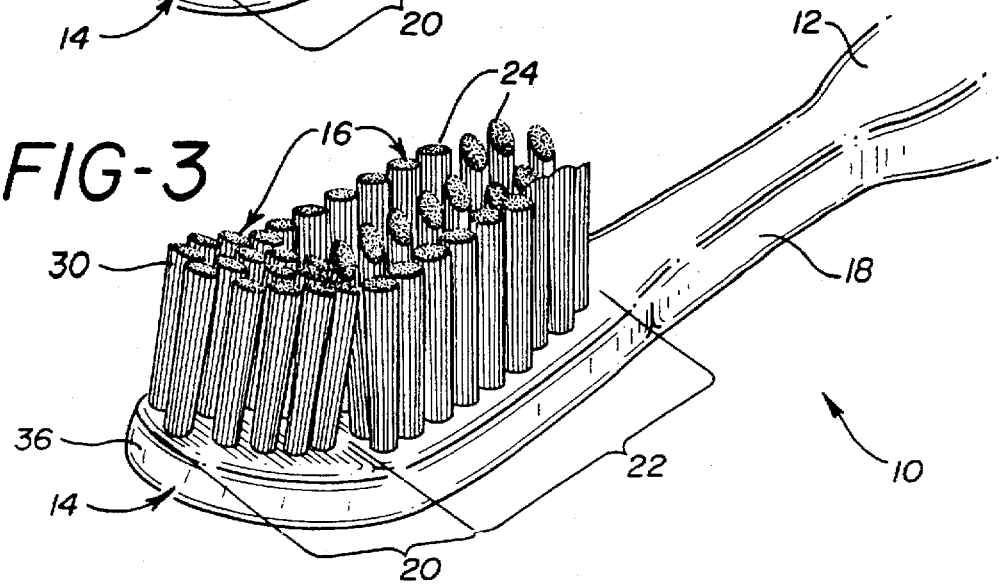

As depicted in FIGS. 1, 2 and 3, preferred embodiments of the present invention comprise a toothbrush, generally indicated as 10, which achieves improved cleaning of the gingival margin in combination with improved interproximal cleaning. Generally, the toothbrush includes an elongated handle member 12, a head member 14 and a multiplicity of bristles 16. Usually, the handle member and the head member are fabricated of the same material as a single injection molded piece, although a multiple material fabrication is also possible. Optionally, the handle and head portions may be joined by a neck member 18 which is often narrower in cross-section than either the handle 12 or head 14.

The head portion of toothbrushes according to the present invention is comprised of two portions. A "toe" portion 20 is the portion of the head located distal to the handle. In contrast, the "heel" portion 22 is the portion of the head which is located proximal to the handle end of the head.

A key feature of the present invention resides in the particular topical representation produced by the distal ends of these bristles. The particular topical representation is achieved by utilizing distinct relative bristle height patterns in the heel 22 and toe 20 regions. Accordingly, a variety of tufting patterns, such as those depicted in FIGS. 1, 2 and 3 achieve the desired result and are contemplated by the present invention.

FIGS. 4, 5, 6 and 7 are end view depictions of the heel portion 22 of toothbrushes according to the present invention. As was mentioned earlier, the heel region bristles 24 are characterized from a longitudinally aligned concave groove shape 28. Preferably, this concave shape 28 forms a "V", as in FIG. 4. However, other shapes, such as "U" (FIG. 5) or a stepwise "V" trim of individual tufts, are also contemplated by the present invention.

Figure 4:
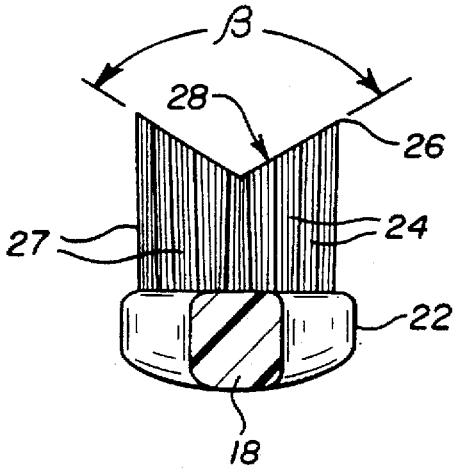
FIG. 4 is an end profile view of the heel region of a preferred embodiment of the present invention.
Figure 5:
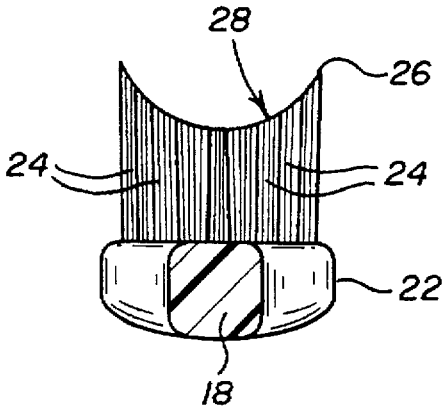
FIG. 5 is an end profile view of the heel region of an alternate embodiment of the present invention.
Figure 6:
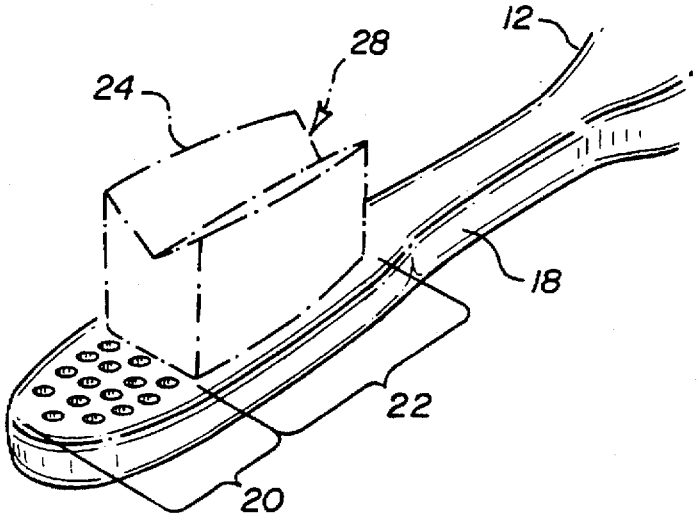
FIG. 6 is a perspective view of a preferred groove-cut utilizing the groove configuration of FIG. 4. The toe tufts have been removed for clarity.

FIG. 6 is a perspective view of a preferred groove-cut 28 utilizing the "V" trim pattern of FIG. 4. The toe bristles 30 have been removed for clarity. Preferably, the groove should be cut at a depth of from about 1/16 inches to about 3/16 inches to form angle B. It is apparent that the depth and width of the groove 28 is generally uniform along the longitudinal length of the heel portion 22.

Figure 7:
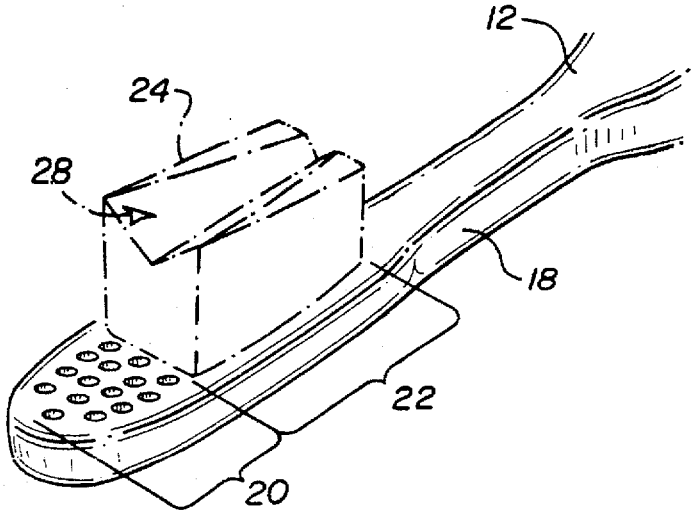
FIG. 7 is a perspective view of an alternative groove-cut utilizing the groove configuration of FIG. 4. The toe tufts have been removed for clarity.

FIG. 7 is a perspective view of an alternate groove-cut 28 utilizing the "V"-trim pattern of FIG. 4. The toe bristles 30 have been removed for clarity. It is apparent that the depth and width of the groove 28 is not constant along the longitudinal length of the heel portion 22. The depth and width decreases as the groove 28 approaches the handle 12 to form an upward slope relative to the surface of the heel portion of the head 22.

FIGS. 6 and 7 are intended to depict preferred embodiments. Other slopes, such as a shallow-to-deep-to-shallow cut, are also contemplated by the present invention. The groove cut 28 in the heel 22 has proved to be particularly suited at cleaning along the gingival margin 34 as seen in FIG. 12.

Figure 8:
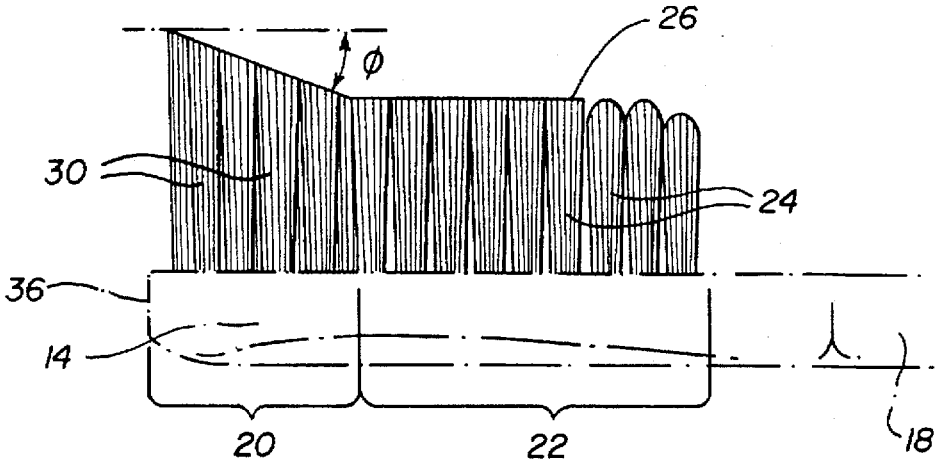
FIGS. 8, 9 and 10 are side profile views of the toothbrush heads of FIGS. 1, 2 and 3, respectively. These figures depict several alternate means of achieving the bristle surface pattern required at the bristle tips of the present invention.
Figure 9:
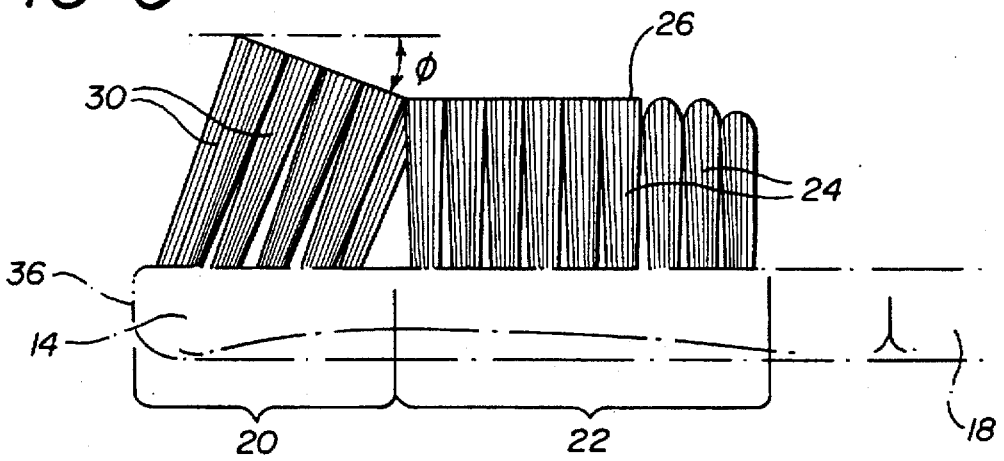
Figure 10:
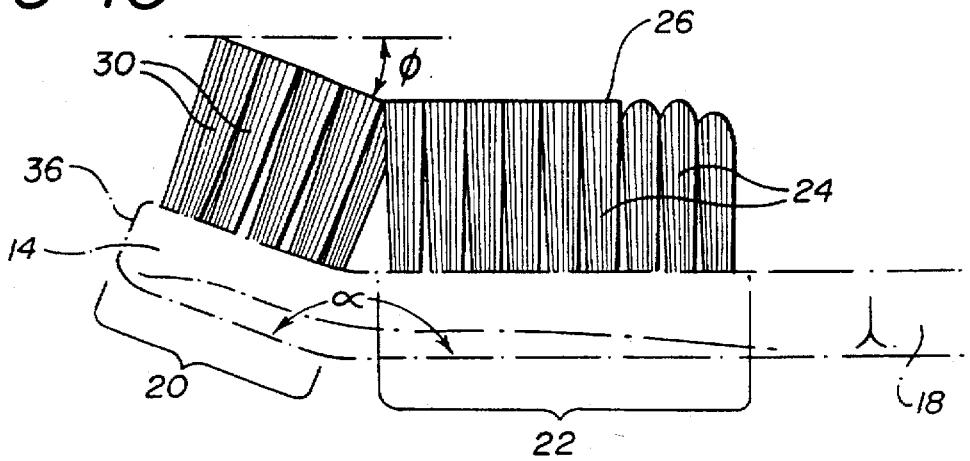

FIGS. 8, 9 and 10 are side profile views of the toothbrush heads of FIGS. 1, 2 and 3, respectively. These Figures are particularly useful in exemplifying the relationship between the bristles on the toe portion 30 of the head in relation to the bristles on the heel portion 24 of the brush. It is key to note the topology produced by the distal ends of the bristles as it is an important characteristic of the present invention. When viewed from the side, as in FIGS. 8, 9 and 10, the preferred "angled-toe" effect which is observed along the bristle tips of the toe vs. the heel is observed. This interface results in angle $\phi$ which is generally from about 0° to about 45°, preferably from about 10° to about 25°. This toe provides deeper bristle-tooth contact along the back of the tooth and into the interproximal areas 32, See FIG. 11.

FIGS. 8, 9 and 10 utilize different approaches to achieve a similar bristle tip topology. In FIG. 8, the toe 20 and heel 22 portions of the head reside on the same general plane. However, the bristles 30 on the toe 20 gradually increase in length as they approach the distal end 36 of the brush. In FIG. 9, the plane of the toe 20 and heel 22 are also generally the same. However, the angle $\phi$ on the bristle tips is produced by inserting the tufts at an angle into the toe portion of the head. The angle $\phi$ can be greater than or less than the angle of the toe tuft holes since the bristle tips can be trimmed independently. And finally, FIG. 10 provides the angle viewed at the bristle tips by bending the head of the toothbrush at the toe/heel interface to an angle of about a. Preferably, the obtuse angle of bend a should be from about 115° to about 170°, most preferably from about 155° to about 170°. These and other techniques can be used to achieve the surface topology of bristles according to the present invention.

The bristles of the present invention must be stiff enough to penetrate and remove plaque and debris from the interproximal spaces, yet must be soft enough to penetrate the gingival margin and remove debris and plaque without causing irritation and bleeding. End-rounded bristle tips are preferred.

Any conventional bristle material may be utilized in the present invention. Nylon and polyester are preferred bristle materials. Nylon is the most preferred. Furthermore, when the nylon bristle materials described above are utilized the height of the toe bristles is from about 12/32 to about 17/32 inches and the height of the heel bristles ranges from about 8/32 to about 14/32 inches.

Although particular embodiments of the present invention have been shown and described, modifications may be made to the toothbrush without departing from the teachings of the present invention. For example the heel groove could extend up into the toe region. Accordingly, the present invention comprises all embodiments within the scope of the appended claims.

What is claimed:

1. A toothbrush exhibiting interproximal and gingival margin cleaning comprising:

(a) an elongated handle member;

(b) an elongated head member connected to one end of the handle member comprised of a toe portion distal to the handle and a heel portion proximal to the handle and adjacent said toe portion;

(c) a multiplicity of bristles extending from the heel portion, the free ends of said bristles forming a longitudinally aligned concave groove which extends the entire length of the heel portion and wherein the free ends of the bristles of the heel portion proximal to said toe portion form a generally linear profile when viewed from the side; and (d) a multiplicity of bristles extending from the toe portion, wherein the side profile view of the free ends of all of the bristles extending from the toe portion forms a generally linear surface which forms an obtuse angle relative to said generally linear profile of the free ends of the bristles extending from the heel portion proximal to said toe potion and wherein the side profile of said toe portion bristles results in a wedge shape with the tallest toe portion bristles being at the end of the head which is distal to said handle.

2. A toothbrush according to claim 1 wherein the head member provides a generally planar surface proximal to the bristles.

3. A toothbrush according to claim 2 wherein the multiplicity of bristles extending from the toe portion extend perpendicular to the toe portion of the head member.

4. A toothbrush according to claim 3 wherein the side profile view of the free ends of the bristles extending from the toe portion form a generally linear surface which forms an obtuse angle of more than about 135° relative to said generally linear profile of the free ends of the bristles extending from the heel portion proximal to said toe portion.

5. A toothbrush according to claim 4 wherein the side profile view of the free ends of the bristles extending from the toe portion form a generally linear surface which forms an obtuse angle of from about 155° to about 170° relative to said generally linear profile of the free ends of the bristles extending from the heel portion proximal to said toe portion.

* * * * *

UNITED STATES PATENT AND TRADEMARK OFFICE

CERTIFICATE OF CORRECTION

PATENT NO. : 5,742,972
APPLICATION NO. : 08/803704
DATED : April 28, 1998
INVENTOR(S) : Bredall et al.

It is certified that error appears in the above-identified patent and that said Letters Patent is hereby corrected as shown below:

| | |
|---|---|
| Cover Page, [63] | Delete: "Continuation of Ser. No. 573,735, Dec. 18, 1995, abandoned, which is a continuation of Ser. No. 409,616, Mar. 23, 1995, abandoned, which is a continuation of Ser. No. 970,327, Nov. 2, 1993, abandoned." |
| | Insert -- Continuation of Ser. No. 573,735, Dec. 18, 1995, abandoned, which is a continuation of Ser. No. 409,616, Mar. 23, 1995, abandoned, which is a continuation of Ser. No. 07/970,327, Nov. 2, 1992, abandoned. -- |
| Column 1, lines 3-7 | Delete: "This application is a continuation of Ser. No. 08/573,735, filed Dec. 18, 1995, now abandoned which is a continuation of Ser. No. 08/409,616, filed Mar. 23, 1995, now abandoned which is a continuation of Ser. No. 07/970,327 filed Nov. 2 1993, now abandoned." |
| | Insert -- This application is a continuation of Ser. No. 08/573,735, filed Dec. 18, 1995, now abandoned, which is a continuation of Ser. No. 08/409,616, filed Mar. 23, 1995, now abandoned, which is a continuation of Ser. No. 07/970,327 filed Nov. 2, 1992, now abandoned. -- |

Signed and Sealed this

Seventh Day of April, 2009

John Doll

JOHN DOLL
*Acting Director of the United States Patent and Trademark Office*